United States Patent [19]

Clemens

[11] 4,072,000

[45] Feb. 7, 1978

[54] HARNESS RACING HITCH

[76] Inventor: John E. Clemens, 1460 U.S. 35 East, Xenia, Ohio 45385

[21] Appl. No.: 648,719

[22] Filed: Jan. 13, 1976

[51] Int. Cl.[2] ..... B68B 1/00

[52] U.S. Cl. ..... 54/2; 54/39

[58] Field of Search ..... 54/2, 39, 43, 1, 50, 54/51; 280/63, 64

[56] References Cited

U.S. PATENT DOCUMENTS

| | | | |
|---|---|---|---|
| 321,652 | 7/1885 | Siebel | 54/1 |
| 573,306 | 12/1896 | Spencer | 54/43 |
| 734,471 | 7/1903 | Pulman | 54/39 |
| 3,847,408 | 11/1974 | King | 54/2 X |

FOREIGN PATENT DOCUMENTS

| | | | |
|---|---|---|---|
| 785,826 | 1935 | France | 54/1 |

*Primary Examiner*—Louis G. Mancene
*Assistant Examiner*—Peter K. Skiff
*Attorney, Agent, or Firm*—Henry P. Wilder

[57] ABSTRACT

A harness racing hitch in which the horse and the sulky are coupled together allowing the horse improved freedom to lean into the turns of a racetrack, to pivot between the sulky shafts and to be able to move up and down with respect to the sulky. The sulky shafts are interconnected by a yoke which overlies and is attached to the saddle of the horse harness by a coupling allowing the horse limited but sufficient free movement in all three planes of motion.

2 Claims, 3 Drawing Figures

15
21
23
27
25
17

11

13
13
15
17
21
25
28
17
13
15
19

HARNESS RACING HITCH

BACKGROUND OF INVENTION

A racing sulky comprises a two-wheel cart having rigid shafts extending forward of the axle upon which the wheels are mounted. The driver's seat is positioned behind the axle. Thus, the attachment of the sulky to the horse exerts a downward pull on the shafts and also controls the longitudinal and lateral stability of the sulkie.

A horse rigged in a conventional racing harness and hitched to a two-shaft sulky is confined by this procedure so that the horse is forced to remain in a position dictated by the sulky shafts. Many racetracks, particularly on the inside next to the rail which is the preferred racing position, are essentially flat even around the turns. The result is that the horse makes the turns around the race track in an artificial near-vertical position created by the relationship of the shafts to the sulky and the sulky wheels to the track. While many horses learn to accommodate to such artificial restraints, they are frequently not running naturally and at their best speeds.

The present invention permits the horse to lean into the turns so as to maintain a natural balance between centrifugal force and gravity. In addition, it allows the compensating for a misplaced center of turn created by the sulky wheels being behind the horse. Also it permits small up and down motions of the horse with respect to the sulky due to motions of the horse or the sulky caused by unevenness of the track.

The present invention also allows owners of racing equipment to utilize their present sulkies and harness, with modification, while still providing improved performance from the conventional equipment.

SUMMARY OF INVENTION

In the present invention, the shafts of a conventional sulky are interconnected by a yoke of rigid material. This yoke overlays and is flexibility connected to the saddle of the horse harness. The harness is secured to the horse, and the yoke is connected thereto through a coupling, such as a ball-and-socket joint joint, which allows limited movement in three planes.

DESCRIPTION OF DRAWINGS

A preferred embodiment of the present invention is illustrated in the appended drawings, in which.

DETAILED DESCRIPTION OF A SPECIFIC EMBODIMENT

Figures 1, 2, 3:
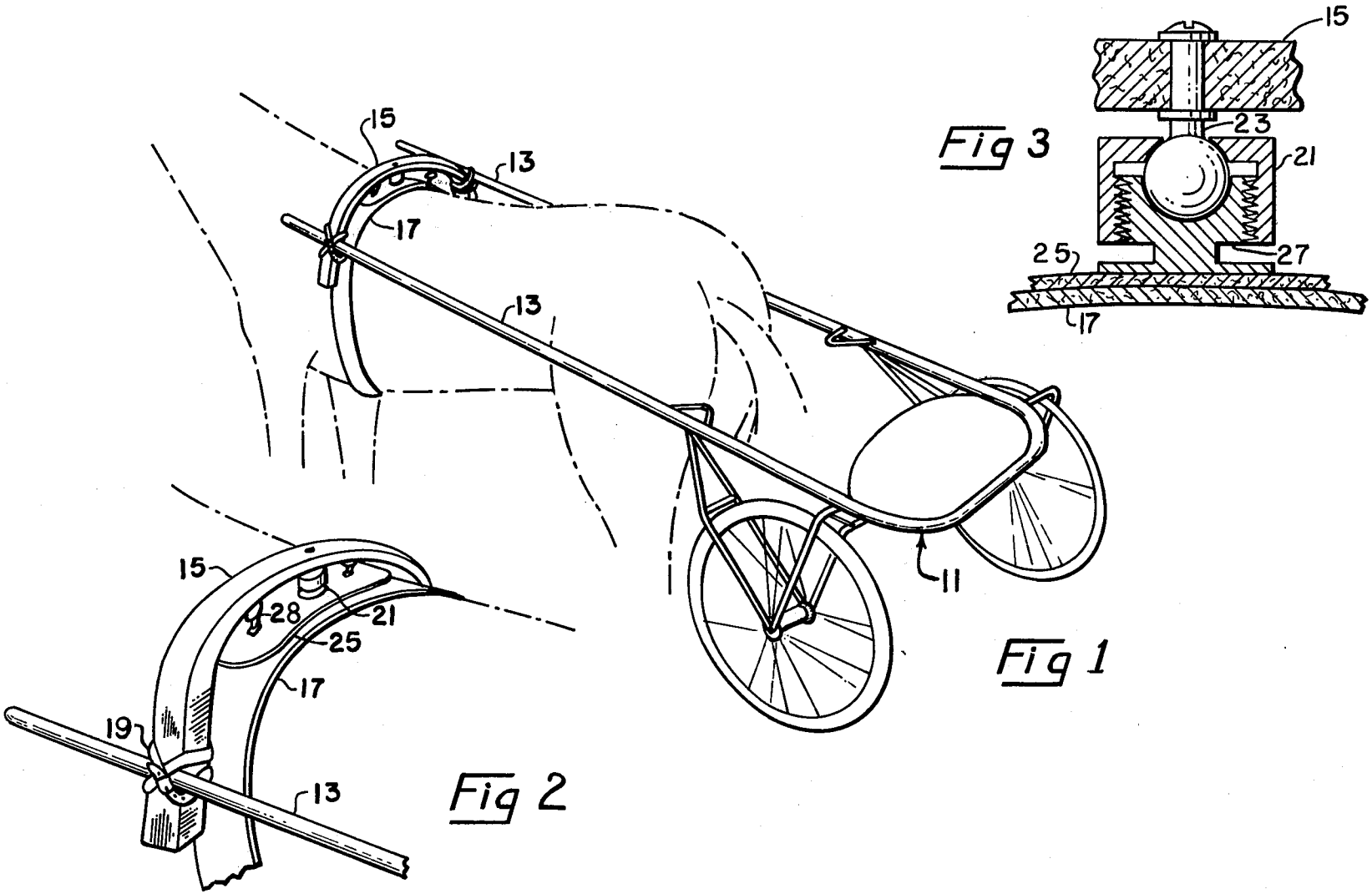
FIG. 1 is a prospective drawing of a harness-sulky hitch made in accordance with the present invention.
FIG. 2 is a detail view showing one method of connection a yoke to a shaft of a conventional sulky.
FIG. 3 is a cross sectional view of a ball-and-socket joint which may be used to connect the yoke to the saddle.

The present invention relates to conventional sulkies such as 11 in FIG. 1, having shafts 13. The shafts 13 extend forward from the sulky substantially parallel to each other and perpendicular to the axis of the sulky wheels. The shafts are connected together by a yoke 15 at a location determined by the position of the saddle 17 on the horse. The yoke should be over the said saddle.

The yoke 15 may be connected to the shafts 13 by means of a leather strap or other flexible material, as indicated by 19 in FIG. 2. If desired, the yoke may be lashed with a thong, connected by a U-bolt, or two bolts with an interconnecting yoke of metal or other suitable material to obtain a permanent and rigid connection of the yoke to the sulky shafts.

The Interconnection between the yoke 15 and the saddle 17 may be made by means of a ball-and-socket joint 21. The ball 23 with the keeper 25 are secured to the yoke, while the socket 27 is adapted to be fastened to the saddle 17.

The ball 23 may be directly connected to the saddle 17, or may be removably connected thereto. For example, the ball may be secured to a binder 25 of leather or other resilient material. This binder may be "buttoned" over the guides 28 for the reins, lashed to the saddle with thongs, or by any other suitable fastening means.

It will be apparent that, while the sulky is firmly secured to the horse for longitudinal and lateral stability, the horse is free to lean or turn relative to the sulky over a small range. The animal is thus free to run naturally and frequently at higher speeds than in a conventional harness.

While the invention has been described with reference to the appended drawings, it will be apparent that it is capable for a number of embodiments which will be readily apparent to those skilled in the art. I desire to be limited only by the appended claims:

What is claimed is:

1. In a hitch for a racing sulky having a single transverse axle and two forwardly extending shafts for connection to the horse wherein the driver is situated behind the axle, whereby the shafts exert an upward force on the horse, a harness saddle adapted to be positioned on the back of and secured about the body of the horse, a rigid U-shaped yoke overlaying said saddle, said yoke being rigidly connected to both shafts adjacent the ends thereof, and pivotal means for connecting the underside portion of the apex of said yoke to the top of said saddle, whereby the shafts are secured to the horse only through said yoke.

2. The hitch of claim 1 wherein said pivotal means connecting the apex of said yoke to the top of said saddle is a ball-and-socket joint.

* * * * *